US008384706B2

(12) United States Patent
Seo et al.

(10) Patent No.: US 8,384,706 B2
(45) Date of Patent: Feb. 26, 2013

(54) ORGANIC LIGHT EMITTING DISPLAY AND DRIVING METHOD THEREOF

(75) Inventors: Hae-Kwan Seo, Yongin (KR); Yong-Sung Park, Yongin (KR); Tae-Jin Kim, Yongin (KR); Bon-Seog Gu, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 7 days.

(21) Appl. No.: 12/984,722

(22) Filed: Jan. 5, 2011

(65) Prior Publication Data

US 2012/0038608 A1 Feb. 16, 2012

(30) Foreign Application Priority Data

Aug. 10, 2010 (KR) ..... 10-2010-0076849

(51) Int. Cl.
*G09G 5/00* (2006.01)

(52) U.S. Cl. ..... 345/211; 345/76; 345/83; 345/92

(58) Field of Classification Search ..... 345/76–83, 345/92, 211, 213
See application file for complete search history.

(56) References Cited

U.S. PATENT DOCUMENTS

2005/0140604 A1* 6/2005 Shin ..... 345/76
2005/0243037 A1* 11/2005 Eom et al. ..... 345/76
2006/0103611 A1* 5/2006 Choi ..... 345/82
2006/0139253 A1* 6/2006 Choi et al. ..... 345/76
2006/0145965 A1* 7/2006 Choi et al. ..... 345/76
2007/0024544 A1* 2/2007 Chung et al. ..... 345/76
2007/0085781 A1* 4/2007 Chung et al. ..... 345/76
2007/0126683 A1* 6/2007 Sung et al. ..... 345/92
2007/0279345 A1* 12/2007 Kim ..... 345/80
2010/0103160 A1* 4/2010 Jeon et al. ..... 345/213

FOREIGN PATENT DOCUMENTS

KR 1020090073688 A 7/2009
KR 1020090090673 A 8/2009
KR 1020090092644 A 9/2009

* cited by examiner

*Primary Examiner* — Amare Mengistu
*Assistant Examiner* — Premal Patel
(74) *Attorney, Agent, or Firm* — Robert E. Bushnell, Esq.

(57) ABSTRACT

An organic light emitting diode display that includes a pixel unit including a plurality of scanning lines, a plurality of data lines, a plurality of first control lines, a plurality of second control lines, a first power source, a second power source and a third power source, a pixel unit including a plurality of pixels connected to the scanning lines, the data lines, the first control lines, the second control lines, the first power source, the second power source, and the third power source, a control line driving unit configured to provide each of said pixels with a first control signal and a second control signal through the first control lines and the second control lines respectively, a scan driving unit configured to provide each of said pixels with scanning signals through the scanning lines and a data driving unit configured to provide each of said pixels with data signals.

14 Claims, 5 Drawing Sheets

ORGANIC LIGHT EMITTING DISPLAY AND DRIVING METHOD THEREOF

CLAIM OF PRIORITY

This application makes reference to, incorporates the same herein, and claims all benefits accruing under 35 U.S.C. §119 from an application for ORGANIC LIGHT EMITTING DISPLAY AND DRIVING METHOD THEREOF earlier filed in the Korean Intellectual Property Office on 20 Aug. 2010 and there duly assigned Serial No. 10-2010-0076849.

BACKGROUND OF THE INVENTION

1. Field of the Invention

The present invention relates to an organic light emitting display and a driving method thereof, and more particularly, relates to an organic light emitting display capable of removing motion blurring through the insertion of black data, and a driving method thereof.

2. Description of the Related Art

In recent years, various flat panel displays have been developed that can overcome the disadvantages of cathode ray tubes (CRTs), such as their heavy weight and their large volume. Such flat panel displays include liquid crystal displays (LCDs), field emission displays (FEDs), plasma display panels (PDPs), and organic light emitting diode (OLED) displays.

Specifically, the OLED display displays an image by using an organic light emitting diode that generates light through the recombination of electrons and holes. Such an OLED display is advantageous in that it has a fast response speed and is driven with low consumption power.

SUMMARY OF THE INVENTION

Accordingly, the present invention has been made to provide an organic light emitting diode display capable of removing motion blurring through the insertion of black data, and a driving method thereof.

Furthermore, another object of the present invention is to provide an organic light emitting diode display that enables the insertion of black data even without a change in a frequency, and a driving method thereof.

In order to achieve the foregoing and/or other aspects of the present invention, there is provided an organic light emitting display including a plurality of scanning lines, a plurality of data lines, a plurality of first control lines, a plurality of second control lines, a first power source, a second power source and a third power source, a pixel unit including a plurality of pixels connected to the scanning lines, the data lines, the first control lines, the second control lines, the first power source, the second power source, and the third power source, a control line driving unit configured to provide each of said pixels with a first control signal and a second control signal through the first control lines and the second control lines respectively, a scan driving unit configured to provide each of said pixels with scanning signals through the scanning lines and a data driving unit configured to provide each of said pixels with data signals through the data lines, the scan driving unit may be configured to provide each of said scanning lines with a first scanning signal and a second scanning signal during each frame period.

The second scanning signal may be shifted by a predetermined period of time as compared to the first scanning signal. The second control signal may have a phase opposite to a phase of the first control signal. The third power source may have a voltage which is equal to a voltage of the first power source. The data signal of the data line may be applied to the first node when the first scanning signal is being supplied to the one of the scanning lines, and a voltage of the third power source may be applied to the first node when the second scanning signal is being supplied to the scanning line.

Each pixel may include a first transistor having a first electrode connected to the first power source, a second electrode connected to a first electrode of a second transistor, and a gate electrode connected to a first node, the second transistor having a second electrode connected to an anode electrode of an organic light emitting diode, and a gate electrode connected to one of the first control lines, a third transistor having a first electrode connected to the third power source, a second electrode connected to a first electrode of a fourth transistor, and a gate electrode connected to one of the scanning lines, the fourth transistor having a second electrode connected to the first node and a gate electrode connected to the one of the first control lines, a fifth transistor having a first electrode connected to one of the data lines, a second electrode connected to a second electrode of a sixth transistor, and a gate electrode connected to one of the second control lines, the sixth transistor having a first electrode connected to the first node and a gate electrode connected to the one of the scanning lines and a storage capacitor having one end connected to the first node and another end connected to the first power source. The first to sixth transistors may each be one of a PMOS transistor, an NMOS transistor or a CMOS transistor.

According to another aspect of the present invention, there is provided a method of driving an organic light emitting diode display, including charging a storage capacitor to a voltage corresponding to a difference between a data signal and a voltage of a first power source during a first period of a frame by supplying a first scanning signal, emitting light via an organic light emitting diode with a brightness corresponding to the voltage charged in the storage capacitor during a second period of the frame and charging said storage capacitor to a voltage corresponding to a difference between a voltage of a third power source and the voltage of the first power source during a third period of the frame by supplying a second scanning signal. The third power source may have a voltage that is equal to a voltage of the first power source. No light emission may occur during a fourth period of the frame. The second scanning signal may be shifted by a predetermined period as compared with the first scanning signal.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicated the same or similar components, wherein.

DETAILED DESCRIPTION OF THE INVENTION

Figure 1:
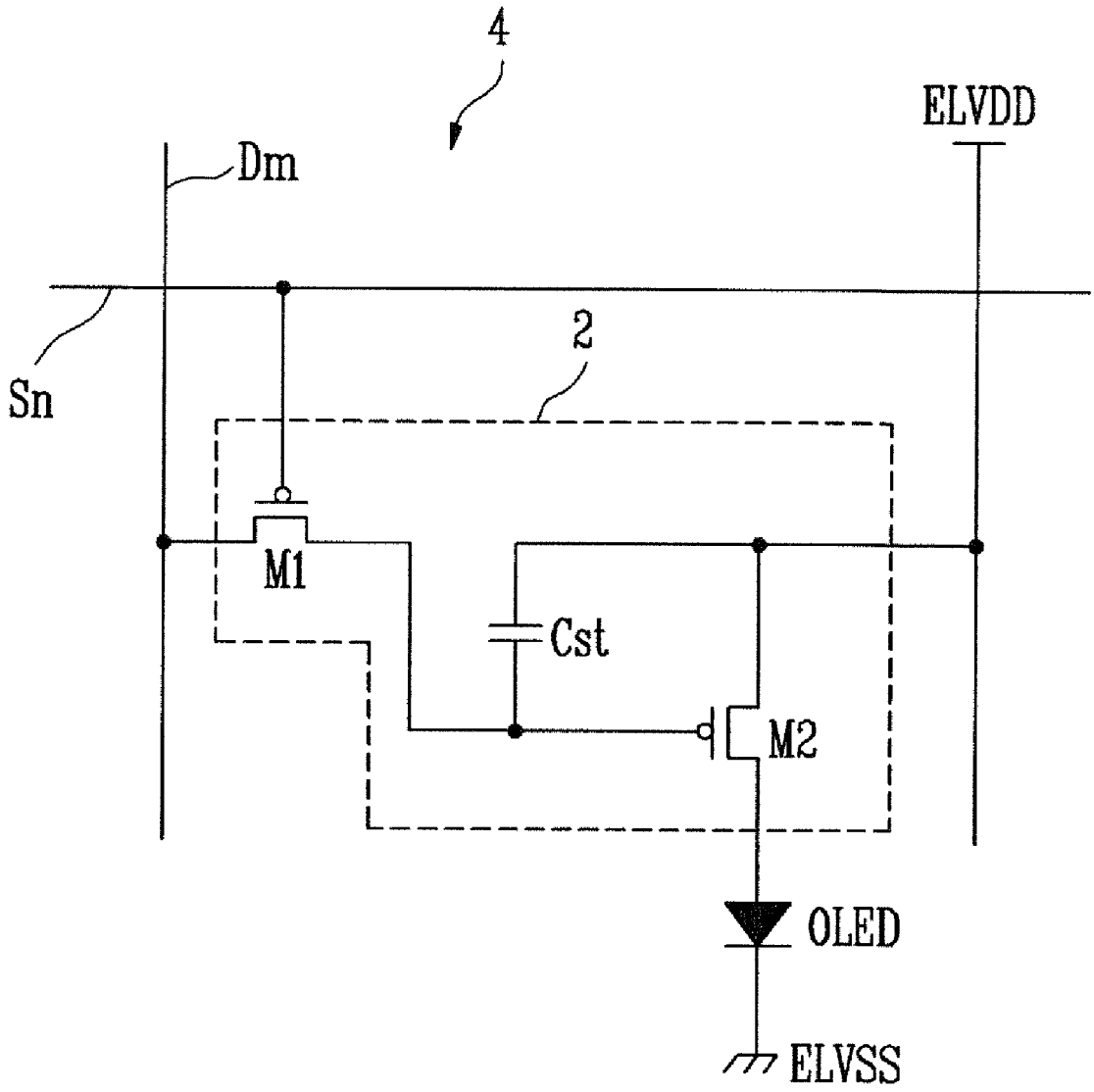
FIG. 1 is a circuit diagram illustrating a pixel of an organic light emitting diode (OLED) display.

Hereinafter, certain exemplary embodiments according to the present invention will be described with reference to the accompanying drawings. Here, when a first element is described as being coupled to a second element, the first element may be not only directly coupled to the second embodiment but may also be indirectly coupled to the second element via a third embodiment. Further, some of the elements that are not essential to the complete understanding of the invention are omitted for clarity. Also, like reference numerals refer to like elements throughout.

Details of other embodiments are included in the detailed description and the accompanying drawings.

The advantages, features and a scheme for the advantages and features of the present invention will become readily apparent by reference to the following detailed description when considered in conjunction with the accompanying drawings. However, the scope of the present invention is not limited to such embodiments and the present invention may be realized in various forms. In the following detailed description, when an element is referred to as being "connected to" another element, it can be directly connected to the another element or be electrically connected to the another element with one or more intervening elements interposed therebetween. Also, in the drawings, parts not associated with the present invention have been omitted in order to clarify the description of the present invention, and the same reference numerals are used to designate the same elements throughout the drawings.

FIG. 1 is a circuit diagram illustrating a pixel of an organic light emitting diode (OLED) display. Referring to FIG. 1, the pixel 4 of the OLED display includes an organic light emitting diode (OLED), and a pixel circuit 2 connected to a data line Dm and a scanning line Sn to control the OLED. An anode electrode of the OLED is connected to the pixel circuit 2, and a cathode electrode of the OLED is connected to a ground power source ELVSS.

Such an OLED generates light of a predetermined brightness in response to a current supplied from the pixel circuit 2. The pixel circuit 2 controls the amount of a current that is supplied to the OLED in response to a data signal supplied to the data line Dm when a scanning signal is being supplied to the scanning line Sn. To this end, the pixel circuit 2 includes a second transistor M2 connected between a first power source ELVDD and the OLED, a first transistor M1 connected among the second transistor M2, the data line Dm and the scanning line Sn, and a storage capacitor Cst connected between a gate electrode and a first electrode of the second transistor M2.

A gate electrode of the first transistor M1 is connected to the scanning line Sn and a first electrode of the first transistor M1 is connected to the data line Dm. A second electrode of the first transistor M1 is connected to one terminal of the storage capacitor Cst. The first electrode of first transistor M1 may be one of the source electrode and the drain electrode, and the second electrode is another of the source electrode and the drain electrode. For example, if the first electrode is the source electrode, the second electrode is the drain electrode. When a scanning signal is supplied from the scanning line Sn, the first transistor M1 connected to the scanning line Sn and the data line Dm is turned on to supply the storage capacitor Cst with a data signal supplied from the data line Dm. The storage capacitor Cst charges a voltage corresponding to the data signal.

The gate electrode of the second transistor M2 is connected to the one terminal of the storage capacitor Cst, and the first electrode of the second transistor M2 is connected to the other terminal of the storage capacitor Cst and to the first power source ELVDD. A second electrode of the second transistor M2 is connected to an anode electrode of the OLED. Such a second transistor M2 controls the amount of a current that flows to the ground power source ELVSS via the OLED, in response to the value of the voltage stored in the storage capacitor Cst. In pixel 4 of FIG. 1, the OLED generates light having a brightness corresponding to the amount of current supplied by the second transistor M2.

However, different from a cathode ray tube, the OLED display causes motion blurring in which an object is not clear but blurred due to the sustain characteristics of the capacitor Cst when a dynamic image is being displayed. In order to prevent such motion blurring, there has been proposed a black data insertion scheme for inserting black data among image frames.

However, since the data line Dm is shared by a plurality of pixels in the pixel structure as illustrated in FIG. 1, if a scanning signal is supplied more than once, data may be written in an undesired line and be displayed on a screen. Therefore, it may not be possible to supply the scanning signal more than once in a single frame.

In this regard, in order to black data, it is necessary to replace image data supplied to a specific frame with the black data. That is, the black data is inserted at the point in time at which a first image frame is displayed and then a second image frame is displayed.

As a result, for example, in the case of 60 Hz driving, if the black data is inserted without changing a driving frequency, since actually displayed image data corresponds to 30 images, the frame frequency is essentially reduced to 30 Hz. Thus, in order to display 60 images in one second, it is necessary to use a method by which the frame frequency is set to 120 Hz and 60 actual images and 60 black images are displayed.

Hereinafter, an organic light emitting diode (OLED) display according to exemplary embodiments of the present invention will be described with reference to the accompanying drawings.

Figure 2:
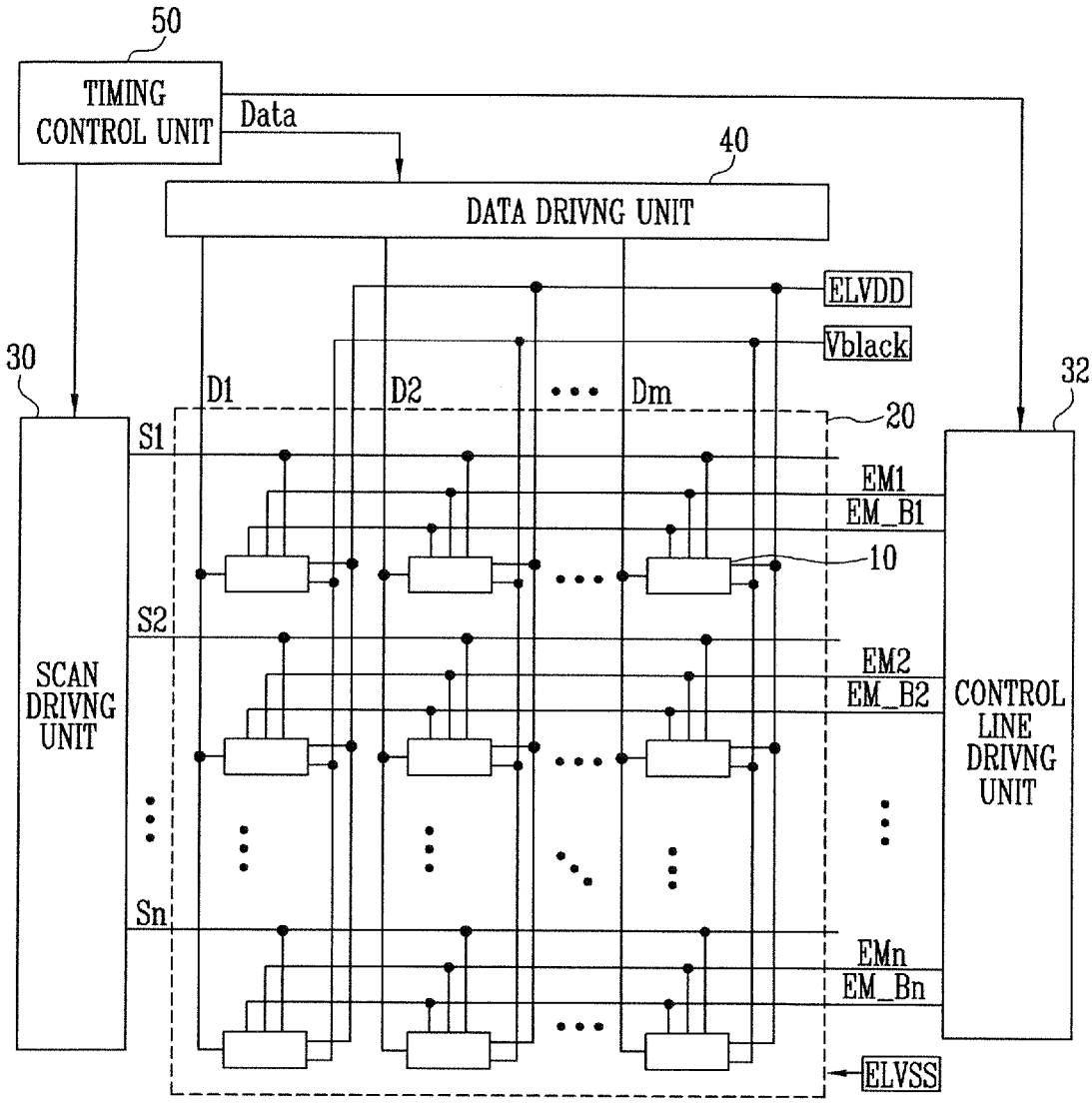
FIG. 2 is a diagram illustrating an OLED display according to a preferred embodiment of the present invention.

Turning now to FIG. 2, FIG. 2 is a diagram illustrating an OLED display according to a preferred embodiment of the present invention. Referring to FIG. 2, the OLED display according to the preferred embodiment of the present invention includes a pixel unit 20, a control line driving unit 32, a scan driving unit 30, a data driving unit 40, and a timing control unit 50. The pixel unit 20 includes a plurality of pixels 10 connected to scanning lines S1 to Sn, first control lines EM1 to EMn, second control lines EM_B1 to EMn_Bn, data lines D1 to Dm, a first power source ELVDD, a second power source ELVSS, and a third power source Vblack. The control line driving unit 32 supplies each pixel 10 with a first control signal and a second control signal through the first control lines EM1 to EMn and the second control lines EM_B1 to Emn_Bn respectively. The scan driving unit 30 supplies each pixel 10 with scanning signals through the scanning lines S1 to Sn. The data driving unit 40 supplies each pixel 10 with data signals through the data lines D1 to Dm. The timing control unit 50 controls the scan driving unit 30, the control line driving unit 32, and the data driving unit 40.

The control line driving unit 32 generates the first control signal and the second control signal under the control of the timing control unit 50, and sequentially supplies the generated first and second control signals to the first control lines EM1 to EMn and the second control lines EM_B1 to EMn_Bn respectively.

Preferably, the second control signal has a phase opposite to that of the first control signal. That is, when the first control signal is at a high level, the second control signal is at a low level, and when the first control signal is at a low level, the second control signal is at a high level.

In FIG. 2, the control line driving unit 32 is illustrated separately from the scan driving unit 30, however the control line driving unit 32 may instead be included within the scan driving unit 30.

The data driving unit 40 generates data signals under the control of the timing control unit 50, and supplies the generated data signals to the data lines D1 to Dm.

Each pixel 10 is connected to the first power source ELVDD, the second power source ELVSS, and the third power source Vblack. Each pixel 10 receives power from the first power source ELVDD, the second power source ELVSS, and the third power source Vblack, and generates light corresponding to the data signals by using a current flowing from the first power source ELVDD to the second power source ELVSS via the OLED. Furthermore, as a voltage is applied from the third power source Vblack, the generation of current is stopped and the OLED does not emit a light, so that a black image can be displayed.

The scan driving unit 30 generates scanning signals under the control of the timing control unit 50, and sequentially supplies the generated scanning signals to the scanning lines S1 to Sn. In the preferred embodiment of the present invention, the scan driving unit 30 supplies the scanning lines S1 to Sn with a scanning signal twice during a single frame period.

At this time, a first supplied scanning signal of the two scanning signals supplied during a frame period is defined as a first scanning signal, a the later of the two scanning signals in a frame period is defined as a second scanning signal. The second scanning signal is supplied after being shifted by a predetermined period from that of the first scanning signal. Furthermore, it is preferable that the first scanning signal is sequentially supplied to the scanning lines S1 to Sn and the second scanning signal is also sequentially supplied to the scanning lines S1 to Sn.

Figure 3:
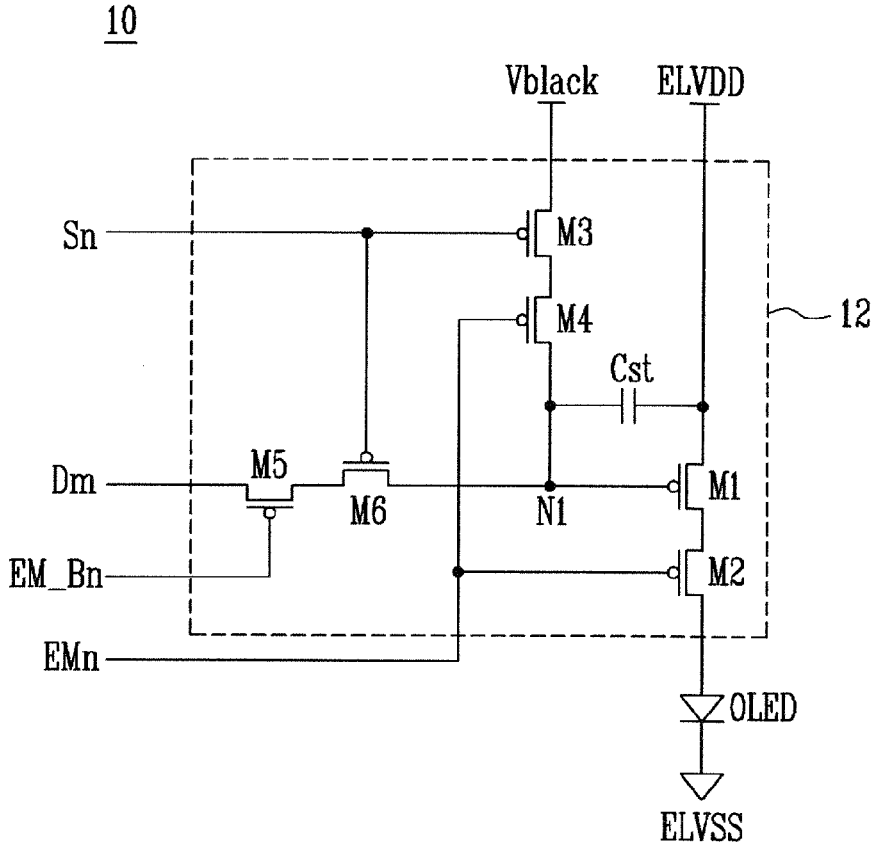
FIG. 3 is a diagram illustrating a pixel according to a preferred embodiment of the present invention.

Turning now to FIG. 3, FIG. 3 is a diagram illustrating a pixel 10 according to the preferred embodiment of the present invention. For the purpose of convenience, FIG. 3 illustrates a pixel connected to the nth scanning line Sn and the mth data line Dm.

Referring to FIG. 3, the pixel 10 according to the preferred embodiment of the present invention includes a pixel circuit 12 which is connected to an OLED, the data line Dm and the scanning line Sn to control the amount of a current supplied to the OLED.

An anode electrode of the OLED is connected to the pixel circuit 12, and a cathode electrode of the OLED is connected to the second power source ELVSS. Such an OLED generates light of a predetermined brightness in response to the current supplied from the pixel circuit 12.

The pixel circuit 12 controls the amount of a current that is supplied to the second power source ELVSS via the OLED from the first power source ELVDD, in response to the data signal supplied to the data line Dm when the scanning signal is supplied to the scanning line Sn.

Pixel circuit 12 includes first to sixth transistors M1 to M6 and a storage capacitor Cst. The first transistor M1 is a driving transistor that generates a current corresponding to a voltage applied to a gate electrode and a first electrode thereof, and supplies the current to the OLED. As illustrated in FIG. 3, the first electrode of the first transistor M1 is connected to the first power source ELVDD, a second electrode of the first transistor M1 is connected to a first electrode of the second transistor M2, and the gate electrode of the first transistor M1 is connected to a first node N1. In the pixel circuit 12, the gate electrode of the first transistor M1, a first electrode of the sixth transistor M6, one terminal of the storage capacitor Cst, and a second electrode of the fourth transistor M4 are all connected to the first node N1.

The first electrode of the second transistor M2 is connected to the second electrode of the first transistor M1, a second electrode of the second transistor M2 is connected to the anode electrode of the OLED, and a gate electrode of the second transistor M2 is connected to the first control line EMn. Furthermore, when the first control signal is supplied from the first control line EMn, the second transistor M2 is turned off so that the transmission of the current from the first transistor M1 to the OLED is stopped. When the first control signal is not supplied, the second transistor M2 maintains a turn-on state.

A first electrode of the third transistor M3 is connected to the third power source Vblack, a second electrode of the third transistor M3 is connected to a first electrode of the fourth transistor M4, and a gate electrode of the third transistor M3 is connected to the scanning line Sn. Furthermore, when the scanning signal is supplied from the scanning line Sn, the third transistor M3 is turned on to transmit the voltage of the third power source Vblack to the fourth transistor M4. When the scanning signal is not supplied, the third transistor M3 maintains a turn-off state.

A first electrode of the fourth transistor M4 is connected to the second electrode of the third transistor M3, a second electrode of the fourth transistor M4 is connected to the first node N1, and a gate electrode of the fourth transistor M4 is connected to the first control line Emn. Furthermore, when the first control signal is supplied from the first control line EMn, the fourth transistor M4 is turned off so that the voltage of the third power source Vblack is not applied to the first node N1 from the third transistor M3. When the first control signal is not supplied, the fourth transistor M4 is turned on so that the voltage of the third power source Vblack is applied to the first node N1.

The second electrode of the fifth transistor M5 is connected to a second electrode of the sixth transistor M6, and a gate electrode of the fifth transistor M5 is connected to a second control line EM_Bn. Furthermore, when the second control signal is supplied from the second control line EM_Bn, the fifth transistor M5 is turned on so that the data signal is transmitted to the sixth transistor M6 from the data line Dm. When the second control signal is not supplied, the fifth transistor M5 maintains a turn-off state.

The first electrode of the sixth transistor M6 is connected to the first node N1, the second electrode of the sixth transistor M6 is connected to the second electrode of the fifth transistor M5, and a gate electrode of the sixth transistor M6 is connected to the scanning line Sn. When the scanning signal is supplied to the scanning line Sn, the sixth transistor M6 is turned on so that the data signal transmitted by the fifth transistor M5 is applied to the first node N1. When the scanning signal is not supplied, the sixth transistor M6 is turned off so that the data signal is prevented from being applied to the first node N1.

The storage capacitor Cst is connected between the first node N1 and the first electrode of the first transistor M1. Thus, the terminal of the storage capacitor Cst that is connected to first node N1 is also connected to the gate electrode of the first transistor M1, the first electrode of the sixth transistor M6, and the second electrode of the fourth transistor M4. The terminal of the storage capacitor Cst that is connected to the first electrode of the first transistor M1 is also connected to the first power source ELVDD.

The data signal supplied to the data line Dm or the voltage of the third power source Vblack can be applied to the terminal of the storage capacitor Cst that is connected to first node N1. Thus, the storage capacitor Cst charges a voltage corresponding to the difference between the data signal and the voltage of the first power source ELVDD, or a voltage corresponding to the difference between the voltage of the third power source Vblack and the voltage of the first power source ELVDD. The first transistor M1 generates a current corresponding to the voltage charged in the storage capacitor Cst.

An anode electrode of the OLED is connected to the second electrode of the second transistor M2, and a cathode electrode of the OLED is connected to the second power source ELVSS. With such a configuration, the OLED generates light having a brightness that corresponds to the current of the first transistor M1.

The first power source ELVDD is a high-potential power source and is connected to the first electrode of the first transistor M1 and one terminal of the storage capacitor Cst. The second power source ELVSS is a low-potential power source with a voltage lower than that of the first power source ELVDD and is connected to the cathode electrode of the OLED.

The third power source Vblack applies a black data signal for partial black processing to the gate electrode of the first transistor M1 during one period in a frame, and is connected to the first electrode of the third transistor M3. Furthermore, the third power source Vblack is for inserting black data such that the OLED does not emit any light, and may have a voltage higher than the voltage of the first power source ELVDD such that the first transistor M1 is turned off. Specifically, it is preferable that the voltage of the third power source Vblack be equal to that of the first power source ELVDD. This is because when the voltage of the third power source Vblack is allowed to be equal to that of the first power source ELVDD, two power sources with different voltages are not necessary.

It is apparent to those skilled in the art that the above-described first to sixth transistors M1 to M6 are not restricted to PMOS transistors as illustrated in FIG. 3, but can also be an NMOS transistor or a CMOS transistor.

Figure 4:
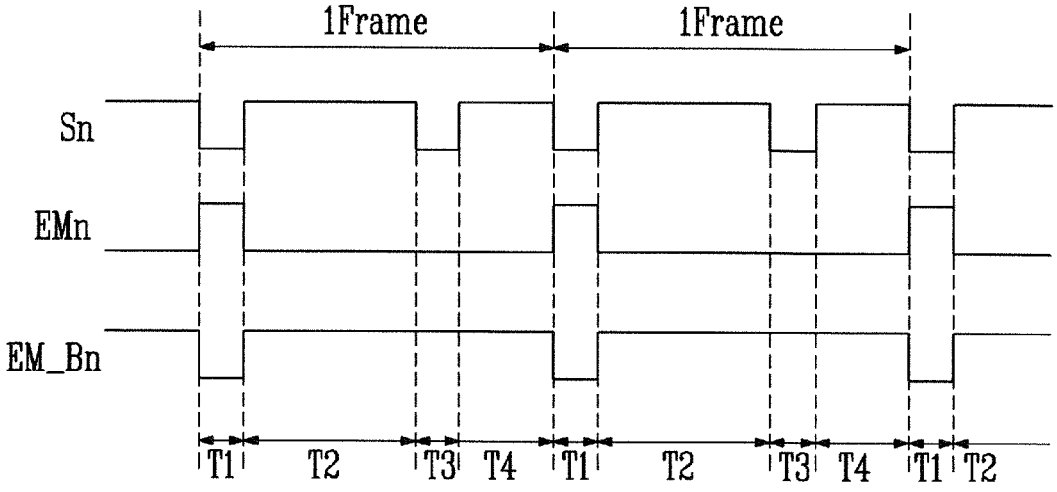
FIG. 4 is a diagram illustrating a waveform for driving the pixel illustrated in FIG. 3.

Turning now to FIG. 4, FIG. 4 is a diagram illustrating a waveform for driving the pixel illustrated in FIG. 3. Hereinafter, the operation of the OLED display according to a driving method of the present invention will be described with reference to FIGS. 3 and 4.

The driving period of the present invention is divided into a first scanning signal supply period T1 in which the data signal is input according to each frame, a light emitting period T2 in which a light is emitted with a brightness corresponding to the data signal, a second scanning signal supply period T3 in which the voltage of the third power source Vblack is input, and a light emission off period T4.

First, the first scanning signal supply period T1 serving as a first period will be described. The first scanning signal is supplied to the scanning line Sn in the first scanning signal supply period T1. Furthermore, the first control signal and the second control signal are supplied to the first control line EMn and the second control line EM_Bn during period T1.

In FIG. 4, the supply period of each control signal is the same as the first scanning signal supply period T1. However, the supply period of each control signal may include the first scanning signal supply period T1.

The first control signal is used for turning off the second transistor M2 and the fourth transistor M4. When the second transistor M2 and the fourth transistor M4 are PMOS transistors as illustrated in FIG. 3, the first control signal has a high level voltage. When the second transistor M2 and the fourth transistor M4 are an NMOS transistor, the first control signal has a low level voltage.

The second control signal is used for turning on the fifth transistor M5. When the fifth transistor M5 is a PMOS transistor as illustrated in FIG. 3, the second control signal has a low level voltage. When the fifth transistor M5 is an NMOS transistor, the second control signal has a high level voltage.

As a result, the first control signal and the second control signal have phases opposite to each other.

In order to apply the data signal supplied to the data line Dm to the first node N1, the sixth transistor M6 is turned on in response to the scanning signal and the fifth transistor M5 is turned on in response to the second control signal.

At this time, the third transistor M3 is also turned on in response to the scanning signal, but the fourth transistor M4 is turned off in response to the first control signal in order to prevent the voltage of the third power source Vblack from being applied to the first node N1.

Furthermore, in order that a voltage corresponding to the data signal is easily charged in the storage capacitor Cst, the second transistor M2 is turned off in response to the first control signal, so that a current is prevented from flowing through the organic light emitting diode OLED.

The scanning signal is used for turning on the third transistor M3 and the sixth transistor M6. When the third transistor M3 and the sixth transistor M6 are PMOS transistors as illustrated in FIG. 3, the scanning signal has a low level voltage. When the third transistor M3 and the sixth transistor M6 are NMOS transistors, the scanning signal has a high level voltage.

The operation of the pixel circuit 12 at this time is as follows. Since the fifth transistor M5 and the sixth transistor M6 are turned on in period T1, the data signal supplied to the data line Dm is applied to the first node N1 including the gate electrode of the first transistor M1 during period T1.

Consequently, the data signal is applied to the gate electrode of the first transistor M1, and the voltage of the first power source ELVDD is applied to the first electrode of the first transistor M1, so that a voltage corresponding to the difference between the data signal and the voltage of the first power source ELVDD is charged in the storage capacitor Cst.

Since a current corresponding to the voltage charged in the storage capacitor Cst is generated by the first transistor M1, but the second transistor M2 is in a turn-off state, a current does not flow through the OLED, so that a light is not emitted during period T1.

Next, the light emitting period T2 serving as a second period will be described. As the supply of the first scanning signal is stopped, the sixth transistor M6 is turned off to stop the supply of the data signal, and the third transistor M3 is turned off to stop the supply of the voltage of the third power source Vblack. In addition to the stopping of the scanning signal, the second control signal is also stopped in period T2, causing the fifth transistor M5 to be turned off. Even though the supply of the data signal can be stopped even if any one of the fifth transistor M5 and the sixth transistor M6 is turned off, both the fifth transistor M5 and the sixth transistor M6 are turned off in second period T2.

In addition to the stopping of the application of the scanning signal to scanning line Sn, the first control signal is no longer applied to the first control line EMn in second period T2. As the supply of the first control signal is stopped, the second transistor M2 is turned on and the current corresponding to the voltage charged in the storage capacitor Cst flows from the first transistor M1 to the OLED, so that the OLED emits light with brightness corresponding to a voltage of the data signal.

Furthermore, as the supply of the first control signal is stopped, the fourth transistor M4 is turned on as the third transistor M3 is turned off, so that the voltage of the third power source Vblack is prevented from being input to first node N1.

In the third period T3, the second scanning signal is supplied to the scanning line Sn causing third transistor M3 to turn on and the first control signal is not supplied to the first control line EMn, causing the fourth transistor M4 to continue to be turned on. With both third and fourth transistors M3 and M4 being simultaneously turned on in the third period T3, the first node N1 is connected to the third power source Vblack.

Also in the third period T3, since the sixth transistor M6 is turned on by the second scanning signal but the second control signal is not supplied to the second control line EM_Bn, the fifth transistor M5 continues to be turned off, so that the transmission of the data signal is stopped.

During period T3, as the supply of the first control signal continues to be turned off, the second transistor M2 is turned while the voltage of the third power source Vblack is applied to the first node N1. With second transistor M2 turned on and first transistor M1 turned off, light emission does not occur in period T3.

In period T3, the third transistor M3 is turned on and the fourth transistor M4 is turned on, so that the voltage of the third power source Vblack is applied to the gate electrode of the first transistor M1 and the charge voltage of the storage capacitor Cst is initialized to a voltage corresponding to the difference between the voltage of the third power source Vblack and the voltage of the first power source ELVDD.

Since the third power source Vblack has a voltage that is higher than that of the first power source ELVDD, the first transistor M1 is turned off during period T3 and light emission does not occur, so that a black image is displayed on a screen.

In the fourth period T4, the supply of the second scanning signal to scanning line Sn is stopped. As the supply of the second scanning signal is stopped, the third transistor M3 is turned off, so that the voltage of the third power source Vblack is prevented from being applied to first node N1 and the gate of the first transistor M1 during the fourth period T4.

Consequently, the voltage of the gate electrode of the first transistor M1 does not change and thus the voltage of the storage capacitor Cst also does not change, so that the first transistor M1 maintains a turn-off state throughout fourth period T4. Because the first transistor M1 maintains the turn-off state in period T4, light emission does not occur during period T4.

At the end of the fourth period T4, the process repeats starting with first period T1 where each of the first scanning signal and the first and second control signals are applied. Table 1 below summarizes the signals that are applied, the state of the transistors, the capacitor and the state of the OLED for each of the four periods in a frame:

| | T1 | T2 | T3 | T4 |
|---|---|---|---|---|
| Sn | first scanning signal applied | Off | second scanning signal applied | Off |
| EMn | On | Off | Off | Off |

-continued

| | T1 | T2 | T3 | T4 |
|---|---|---|---|---|
| EM_Bn | On | Off | Off | Off |
| M1 | On | On | Off | Off |
| M2 | Off | On | On | On |
| M3 | On | Off | On | Off |
| M4 | Off | On | On | On |
| M5 | On | Off | Off | Off |
| M6 | On | Off | On | Off |
| Cst | Charged to ELVDD - Data | Same as T1 | Charged to Vblack - ELVDD | Same as T3 |
| OLED | Off | On | Off | Off |

Figure 5:
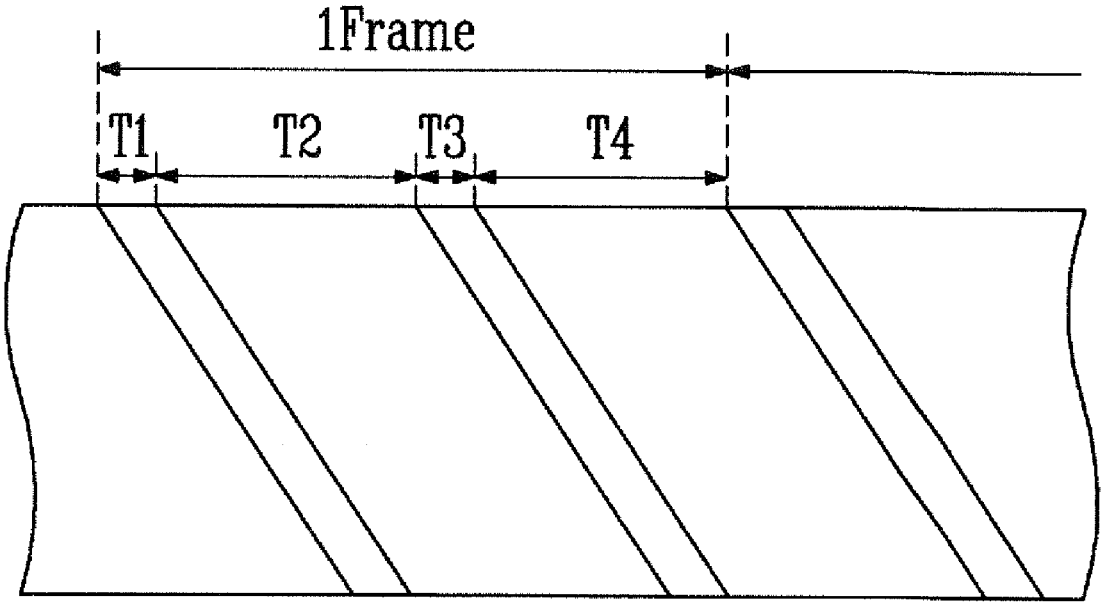
FIG. 5 is a diagram illustrating one frame of an OLED display according to a preferred embodiment of the present invention.
Figure 6:
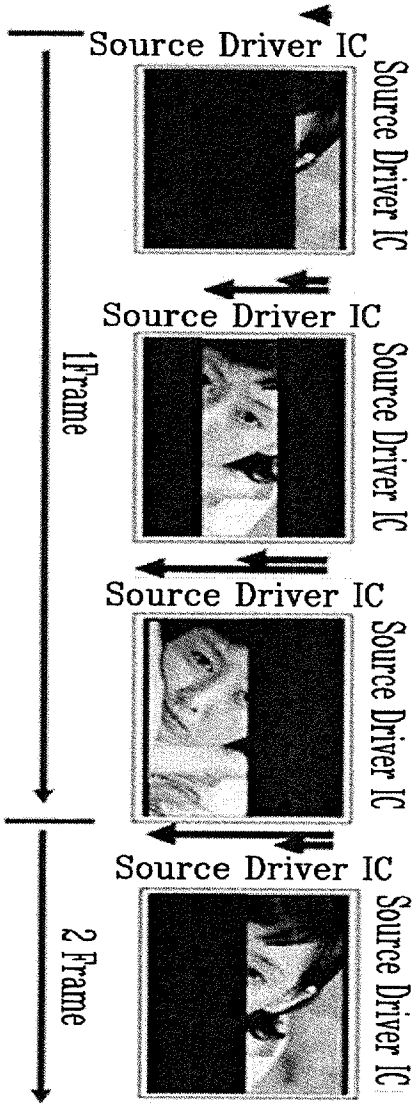
FIG. 6 is a diagram illustrating a screen on which an image is displayed by an OLED display according to a preferred embodiment of the present invention.

Turning now to FIGS. 5 and 6, FIG. 5 is a diagram illustrating one frame of the OLED display versus vertical location on a display screen according to the preferred embodiment of the present invention, and FIG. 6 is a diagram illustrating a screen on which an image is displayed by the OLED display at various points in time during one frame according to the preferred embodiment of the present invention.

Hereinafter, an image display process according to the present invention will be described with reference to FIGS. 5 and 6. First, the scan driving unit 30 sequentially supplies the first scanning signal to the scanning lines S1 to Sn. As the first scanning signal is supplied, light emission starts from the first pixel line and is sequentially continued to subsequent lines as shown in FIG. 6.

If the light emitting period T2 passes, the scan driving unit 30 sequentially supplies the second scanning signal to the scanning lines S1 to Sn. Thus, a black image is sequentially displayed from the first pixel line as shown in FIG. 6. Then, if one frame is completed, the scan driving unit 30 repeats the above-described processes by supplying the first scanning signal and the second scanning signal, so that an image is displayed on the screen. As a result, because the black image is inserted, a motion blurring phenomenon is prevented, so that image quality can be improved. Moreover, as the scanning signal is supplied twice during one frame, it is not necessary to increase a driving speed, so that the life span of elements can be increased and the manufacturing cost can be reduced due to the use of driving parts with low cost.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting diode (OLED) display, comprising:

a plurality of scanning lines, a plurality of data lines, a plurality of first control lines, a plurality of second control lines, a first power source, a second power source and a third power source;

a pixel unit including a plurality of pixels connected to the scanning lines, the data lines, the first control lines, the second control lines, the first power source, the second power source, and the third power source;

a control line driving unit configured to provide each of said pixels with a first control signal and a second control signal through the first control lines and the second control lines respectively;

a scan driving unit configured to provide each of said pixels with scanning signals through the scanning lines; and a data driving unit configured to provide each of said pixels with data signals through the data lines, wherein the scan driving unit is configured to provide each of said scanning lines with a first scanning signal and a second scanning signal during each frame period, wherein each pixel comprises:

a first transistor having a first electrode connected to the first power source, a second electrode connected to a first electrode of a second transistor, and a gate electrode connected to a first node;

the second transistor having a second electrode connected to an anode electrode of an organic light emitting diode, and a gate electrode connected to one of the first control lines;

a third transistor having a first electrode connected to the third power source, a second electrode connected to a first electrode of a fourth transistor, and a gate electrode connected to one of the scanning lines;

the fourth transistor having a second electrode connected to the first node and a gate electrode connected to the one of the first control lines;

a fifth transistor having a first electrode connected to one of the data lines, a second electrode connected to a second electrode of a sixth transistor, and a gate electrode connected to one of the second control lines;

the sixth transistor having a first electrode connected to the first node and a gate electrode connected to the one of the scanning lines; and a storage capacitor having one end connected to the first node and another end connected to the first power source.

2. The OLED display of claim 1, wherein the third power source has a voltage which is equal to a voltage of the first power source.

3. The OLED display of claim 1, wherein the data signal of the data line is applied to the first node when the first scanning signal is being supplied to the one of the scanning lines, and a voltage of the third power source is applied to the first node when the second scanning signal is being supplied to the scanning line.

4. The OLED display of claim 1, wherein the first to sixth transistors each include a transistor selected from a group consisting of a PMOS transistor, an NMOS transistor, and a CMOS transistor.

5. The OLED display of claim 1, wherein the cathode of the organic light emitting diode is connected to the second power source whose voltage is less than each of the first and third power sources.

6. The OLED display of claim 1, wherein each of said first and second scanning signals switches on the third and sixth transistors only.

7. A method of driving an organic light emitting diode display, comprising:

charging a storage capacitor to a voltage corresponding to a difference between a data signal and a voltage of a first power source during a first period of a frame by supplying a first scanning signal;

emitting light via an organic light emitting diode with a brightness corresponding to the voltage charged in the storage capacitor during a second period of the frame; and charging said storage capacitor to a voltage corresponding to a difference between a voltage of a third power source and the voltage of the first power source during a third period of the frame by supplying a second scanning signal.

8. The method of claim 7, wherein the third power source has a voltage which is equal to a voltage of the first power source.

9. The method of claim 8, wherein no light emission occurs during a fourth period of the frame.

10. The method of claim 7, wherein the second scanning signal is shifted by a predetermined period as compared with the first scanning signal.

11. The method of claim 7, wherein the organic light emitting diode display comprises a plurality of pixels, wherein each of said pixels receives the first scanning signal and the second scanning signal from a same scanning line.

12. The method of claim 7, wherein a control signal and a data signal are also applied to each pixel in the first period.

13. The method of claim 7, further comprising a fourth period subsequent to the third period and prior to the first period where a control signal is applied to each pixel and where no light is emitted by the organic light emitting diodes.

14. The method of claim 7, wherein the organic light emitting display comprises a plurality of pixels, each pixel being connected to a scan line, a data line, a first control line, a second control line, an first power source, a second power source and a third power source, each pixel comprising:

a first transistor having a first electrode connected to the first power source, a second electrode connected to a first electrode of a second transistor, and a gate electrode connected to a first node;

the second transistor having a second electrode connected to an anode electrode of an organic light emitting diode, and a gate electrode connected to a first control line;

a third transistor having a first electrode connected to the third power source, a second electrode connected to a first electrode of a fourth transistor, and a gate electrode connected to a scanning line;

the fourth transistor having a second electrode connected to the first node and a gate electrode connected to the first control line;

a fifth transistor having a first electrode connected to a data line, a second electrode connected to a second electrode of a sixth transistor, and a gate electrode connected to a second control line;

the sixth transistor having a first electrode connected to the first node and a gate electrode connected to a scanning line; and a storage capacitor having one end connected to the first node and another end connected to the first power source, wherein during a first period of a frame, the second scanning line turns on the fifth transistor and the first scanning signal turns on the third and sixth transistors to charge the storage capacitor, wherein during the second period of the frame, the first control line turns on the fourth and the second transistors, during the third period, the second scan signal again turns on the third and sixth transistors while the first control signal turns on the second and fourth transistors to charge the storage capacitor via the third power source, and during the fourth period, the first control line turns on the second and fourth transistors.

* * * * *